US008742670B2

(12) United States Patent
Zhong et al.

(10) Patent No.: US 8,742,670 B2
(45) Date of Patent: Jun. 3, 2014

(54) ELECTRONIC BALLAST

(75) Inventors: Yan Zhong, Shanghai (CN); Weiqiang Zhang, Shanghai (CN); JianPing Ying, Shanghai (CN)

(73) Assignee: Delta Electronics (Shanghai) Co., Ltd. (CN)

( * ) Notice: Subject to any disclaimer, the term of this patent is extended or adjusted under 35 U.S.C. 154(b) by 97 days.

(21) Appl. No.: 13/530,380

(22) Filed: Jun. 22, 2012

(65) Prior Publication Data

US 2013/0181608 A1 Jul. 18, 2013

(30) Foreign Application Priority Data

Jan. 18, 2012 (CN) ..... 2012 1 0016226

(51) Int. Cl.
*H05B 41/36* (2006.01)
*H01J 61/52* (2006.01)

(52) U.S. Cl.
USPC ..... 315/115; 315/224

(58) Field of Classification Search
None
See application file for complete search history.

(56) References Cited

U.S. PATENT DOCUMENTS 4,562,383 A * 12/1985 Kerscher et al. ..... 315/225
5,747,942 A * 5/1998 Ranganath ..... 315/224
5,770,925 A * 6/1998 Konopka et al. ..... 315/225
8,049,430 B2 * 11/2011 Newman et al. ..... 315/224

* cited by examiner

*Primary Examiner* — Crystal L Hammond
(74) *Attorney, Agent, or Firm* — Lowe Hauptman & Ham, LLP

(57) ABSTRACT

The electronic ballast includes: a square wave generator that includes a plurality of switching elements to convert a DC input voltage to an AC square wave output voltage; a transformer that includes a driving winding, a plurality of control windings, at least one inductive winding and at least one control driving circuit. The control windings controls the plurality of switching elements to turn on alternately; a resonant circuit that constitutes a resonant loop together with the driving winding is electrically connected with an output terminal of the square wave generator to drive the light emitting element. The control driving circuit is connected with two terminals of the inductive winding in parallel and receives a control signal to control a voltage across the inductive winding so as to control conducting time of at least one of the switching elements.

20 Claims, 11 Drawing Sheets

ELECTRONIC BALLAST

TECHNICAL FIELD

The present application relates to ballast technologies, more particularly to an electronic ballast capable of controlling working current and power of light emitting elements.

BACKGROUND

Nowadays, electronic ballasts are widely used because of advantages such as high efficiency, light weight, and absence of flicker and audible noise over the electromagnetic ballasts. Among the various electronic ballasts for driving light emitting elements (e.g., fluorescent lamps), the self-oscillating electronic ballast is simple and low cost.

However, the self-oscillating electronic ballast has problems as follows. In a self-oscillating circuit, the working frequency of the self-oscillating resonant circuit is determined by load and the nature of its circuit structure, thus it is very difficult to control the output of the self-oscillating electronic ballast. Consequently, the working current or power of light emitting elements is hard to control. In addition, the working frequency of the conventional self-oscillating electronic ballasts and the power of light emitting elements depend on characteristics of driving transformers in the self-oscillating electronic ballasts. For a batch of self-oscillating electronic ballasts with the same circuit design, manufacturing differences of the driving transformers may lead to that light emitting elements in the same batch have different working current.

Therefore, there is a demand for electronic ballast whose working frequency can be controlled so as to make the working current or power of light emitting elements adjustable.

SUMMARY OF THE INVENTION

One object of the present application is to provide electronic ballast whose working frequency can be controlled so as to make the working current and power of light emitting elements adjustable.

In one aspect, the disclosure provides an electronic ballast which includes: a square-wave generator that comprises a plurality of switching elements which turn on alternately to convert a direct current input voltage to an alternating current square wave of output voltage; a transformer that comprises a driving winding, a plurality of control windings and at least one inductive winding, wherein the driving winding, the control windings and the inductive winding are coupled with each other, and the plurality of control windings are electrically connected with control terminals of the plurality of switching elements respectively so as to control the plurality of switching elements; a resonant circuit that constitutes a resonant loop together with the driving winding, is electrically connected with an output terminal of the square wave generator and drives the light emitting element. At least one control winding is connected with two terminals of the inductive winding in parallel. The inductive winding receives a control signal to control a voltage across the control winding so as to control conducting time of the switching element corresponding to the control winding.

In the electronic ballast provided by the disclosure, the control driving circuit controls the voltage of the inductive winding. Because of that, the control driving circuit controls the conducting time of switching element corresponding to the control winding by using the coupling between the inductive winding and the control windings. Therefore, the control on the working frequency of the ballast is realized with the working current or power of light emitting elements adjustable.

The above and other objects, features and advantages of the disclosure will become apparent from the following description of the preferred embodiments with reference to drawings.

DESCRIPTION OF THE EMBODIMENTS

Embodiments of the present application will be described below in detail. It should be noted that the embodiments described herein are for illustration only but not to limit the present application.

Figure 1:
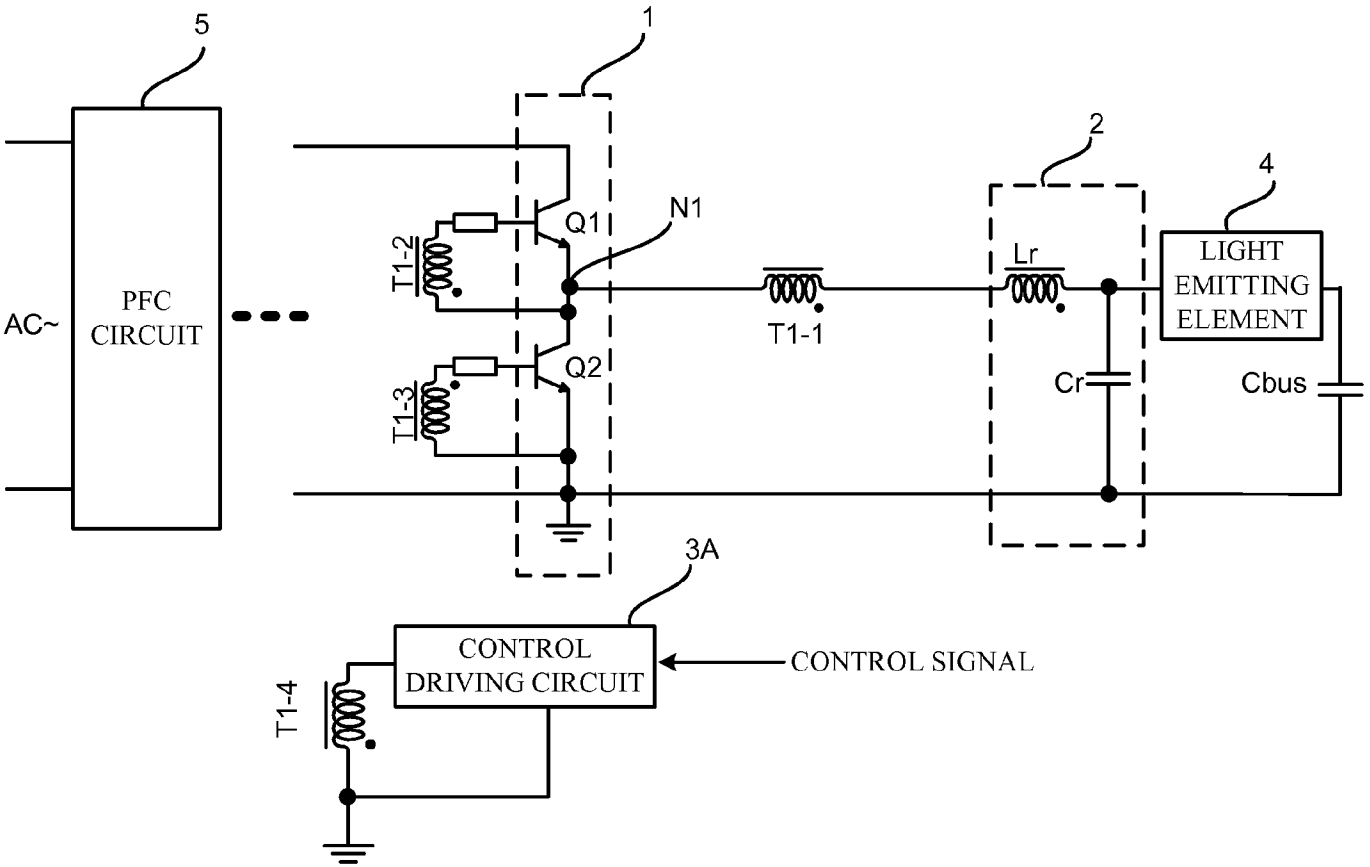
FIG. 1 illustratively shows a structure diagram of an electronic ballast according to a first embodiment of the present application.

FIG. 1 illustratively shows a structure diagram of an electronic ballast according to a first embodiment of the present application. The electronic ballast can be used to drive at least one light emitting element, e.g., a fluorescent lamp, a daylight lamp, a metal halide lamp.

The electronic ballast includes a square wave generator 1, a transformer, a resonant circuit 2 and at least one control driving circuit.

The square wave generator 1 may include a plurality of switching elements which turn on alternately to convert a direct current (DC) input voltage to an alternating current (AC) square wave of output voltage. The square wave generator 1 may be a half-bridge inverter or a full-bridge inverter or the like. The number of switching elements included in the square wave generator 1 may be 2, 4 or more. In FIG. 1, the square wave generator which is a half-bridge inverter is taken as an example for illustration. The square wave generator 1 may include two Bipolar Junction Transistors (BJT) Q1 and Q2 which turn on alternately to convert a DC input voltage to an AC square wave of output voltage. Of course, the plurality of switching elements in the square wave generator 1 are not limited to BJTs, but can also be field effect transistors, e.g., Junction type Field Effect Transistors (JFET) or Metal-Oxide-Semiconductor type Field Effect Transistors (MOSFET).

The transformer may include a driving winding, a plurality of control windings and at least one inductive winding. The driving winding, the plurality of control windings and the at least one inductive winding are coupled with each other. The plurality of control windings are electrically connected with control terminals of the plurality of switching elements respectively so as to control the plurality of switching elements to turn on alternately. As shown in FIG. 1, the transformer may include one driving winding T1-1, two control windings T1-2 and T1-3 and one inductive winding T1-4. The driving winding T1-1, the two control windings T1-2 and T1-3 and the one inductive winding T1-4 may be winded on magnetic cores which are coupled with each other or be winded at different positions of the same magnetic core having a closed magnetic loop, so that the driving winding T1-1, the two control windings T1-2 and T1-3 and the one inductive winding T1-4 can be coupled with each other. The control winding T1-2 is electrically connected with the control terminal of the transistor Q1, the control winding T1-3 is electrically connected with the control terminal of the transistor Q2, and the dotted terminals (i.e. identical terminals or like terminals) of the two control windings T1-2 and T1-3 are connected in opposite manners. For example, as shown in FIG. 1, the dotted terminal of the control winding T1-2 is electrically connected with an emitter of the transistor Q1, and the other terminal is electrically connected with a control electrode, i.e., a base, of the transistor Q1; the dotted terminal of the control winding T1-3 is electrically connected with a base of the transistor Q2, and the other terminal is electrically connected with an emitter of the transistor Q2. Thus, the control windings T1-2 and T1-3 can respectively control the transistors Q1 and Q2 to turn on alternately.

The resonant circuit 2 is electrically connected with an output terminal (i.e., a node N1 at the emitter of the transistor Q1) of the square wave generator 1 and may include a resonant inductor Lr and a resonant capacitor Cr. The resonant circuit 2 is connected with the driving winding T1-1 so as to convert a square wave into an alternating current required for driving a light emitting element 4, and thus the light emitting element 4 can be driven.

In the embodiments of the present application, a control driving circuit is further included. FIG. 1 shows an example where one control driving circuit 3A is included. The control driving circuit 3A may be connected with two terminals of the inductive winding T1-4 in parallel. According to a control signal received, the control driving circuit 3A can control a voltage across the inductive winding T1-4 so as to control the conducting time of at least one of the switching elements. For example, the dotted terminal of the inductive winding T1-4 is connected with the control driving circuit 3A, and the dotted terminal of the control winding T1-2 is connected with control terminal of the transistor Q1. The polarity of the inductive winding T1-4 with reference to the control driving circuit 3A is the same as the polarity of the control winding T1-2 with reference to the transistor Q1. Therefore, the voltage across the inductive winding T1-4 can control the conducting time of the transistor Q1 indirectly by the control driving circuit, the control winding T1-2 and connection thereof. Then, the technical scheme disclosed here could make the switching frequency or the output current or voltage of the entire square wave generator adjustable.

To obtain a high power factor, the electronic ballast may further include a Power Factor Correction (PFC) circuit 5. Of course, the electronic ballast may further include a rectifier circuit or the like which is not shown in FIG. 1, for providing a DC voltage.

The operating principles of the first embodiment will be described below.

In the electronic ballast shown in FIG. 1, the driving winding T1-1 and the resonant circuit 2 are connected in cascade, and the light emitting element 4 emits light under the driving of the resonant circuit. The capacitor Cbus is a DC blocking capacitor. For a batch of electronic ballasts with the same design, the transformer in each electronic ballast is allowed to have a certain manufacturing error (e.g., size error), which will results in electrical parameter differences. Thus, the working frequency of each electronic ballast can vary, causing the light emitting elements driven by a batch of electronic ballasts with the same design to have different working current or power. Moreover, the working frequency of electronic ballasts is hard to control due to the working frequency dependence on the resonant frequency of the resonant circuit 2.

In order to make the working current or working frequency adjustable during a steady operation stage, at least one inductive winding (e.g., T1-4) coupled with every control winding and at least one control driving circuit (e.g., the control driving circuit 3A in FIG. 1) are added in the embodiments of the present application. When the control driving circuit 3A receives a control signal, e.g., when the working current of the light emitting element 4 is greater than a preset current value, the control driving circuit 3A may control the voltage across the inductive winding T1-4, e.g., to decrease. Because the inductive winding T1-4, the control windings T1-2 and T1-3 are coupled with each other, the change of the control windings T1-2 and T1-3 follow the inductive winding T1-4's. According that the polarity of the control winding T1-2 is the same as that of the inductive winding T1-4, if the voltage across the inductive winding T1-4 decreases to below the threshold voltage of the transistor Q1, the transistor Q1 will turn off, which is controlled by the control winding T1-2. Moreover, the voltage across the inductive winding T1-2 is dominated by the control driving circuit 3A. Under the control of the control driving circuit 3A, the conducting time of the transistor Q1 is shortened, which causes the switching frequency of the square wave generator 1 and thereby the working frequency of the electronic ballast become higher. A higher working frequency of the electronic ballast makes the working frequency far from the resonant frequency, which results in a decrease in the working current or power of the light emitting element 4. In the electronic ballast provided by the first embodiment of the present application, using the coupling between the inductive winding T1-4 and the control winding T1-2, the voltage across the inductive winding T1-4 and thereby the voltage across the control winding T1-2 are controlled by the control driving circuit 3A, and thus the conducting time of the transistor Q1 is controlled. Consequently, the control on the working frequency of the electronic ballast is realized. Thus, the working current or power of the light emitting element is controllable.

According to another embodiment of the present application, there may be two inductive windings which may respectively control two switching elements which turn on alternately. There may be two control driving circuits as well, which may be electrically connected with the two inductive windings respectively.

Figure 2:
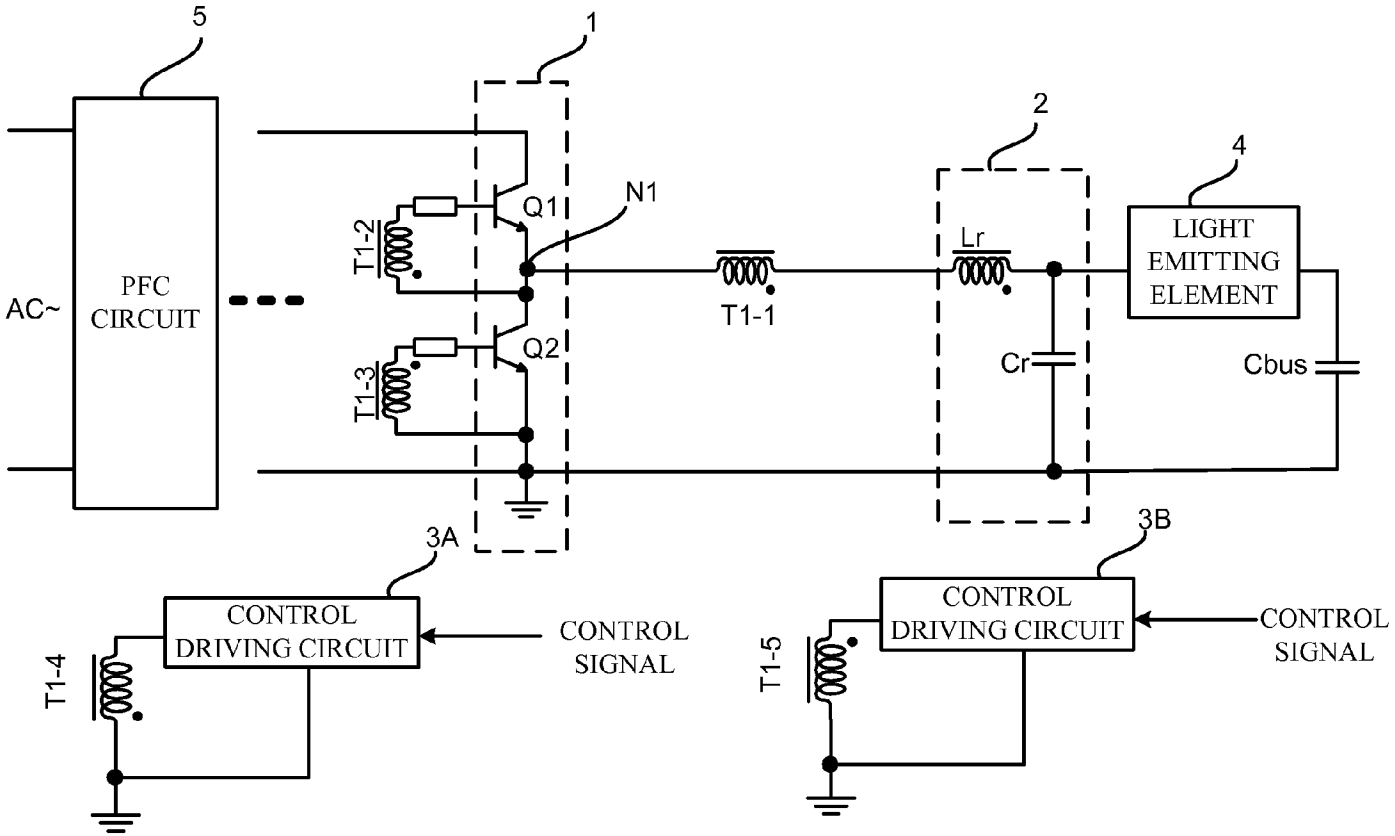
FIG. 2 illustratively shows a structure diagram of an electronic ballast according to a second embodiment of the present application.

FIG. 2 illustratively shows a structure diagram of an electronic ballast according to a second embodiment of the present application. In the structure according to the second embodiment, one inductive winding T1-5 and one control driving circuit 3B are added as compared with the first embodiment. The inductive winding T1-5, the driving winding T1-1, the control windings T1-2 and T1-3 and the inductive winding T1-4 are magnetically coupled with each other. As the voltage across the inductive winding T1-4 decreases under the control of the control driving circuit 3A, the voltage across the control winding T1-2 having the same dotted terminal connection manner as that of the inductive winding T1-4 decreases as well, that results s a shorter conducting time of the transistor Q1. As the voltage across the inductive winding T1-5 decreases under the control of the control driving circuit 3B, the voltage across the control winding T1-3 having the same dotted terminal connection manner as that of the inductive winding T1-5 decreases as well, that results a shorter conducting time of the transistor Q2.

In the second embodiment, by providing the inductive windings T1-4 and T1-5, the conducting time of both the transistors Q1 and Q2 is shortened and thus a broader range of adjustment on the working frequency of the electronic ballast can be realized as compared with the first embodiment. Under the situation where the working frequency of the electronic ballast is required to be changeable in a greater degree, the second embodiment may be employed. The second embodiment can realize a deeper control on the electronic ballast and thereby a broader control on the range of working current of the light emitting element as compared with the first embodiment.

In the embodiments according to the present application, the control driving circuits 3A or 3B may be circuit which is capable of controlling the voltages across the inductive windings, e.g., clamping circuits. The clamping circuits may receive control signals, and trigger its operation to pull down the voltages across the inductive windings so as to make the switching element, controlled by the control winding that is coupled with the inductive windings (e.g., the control winding having the same dotted terminal connection manner as that of the inductive winding), from on to off.

Figure 3:
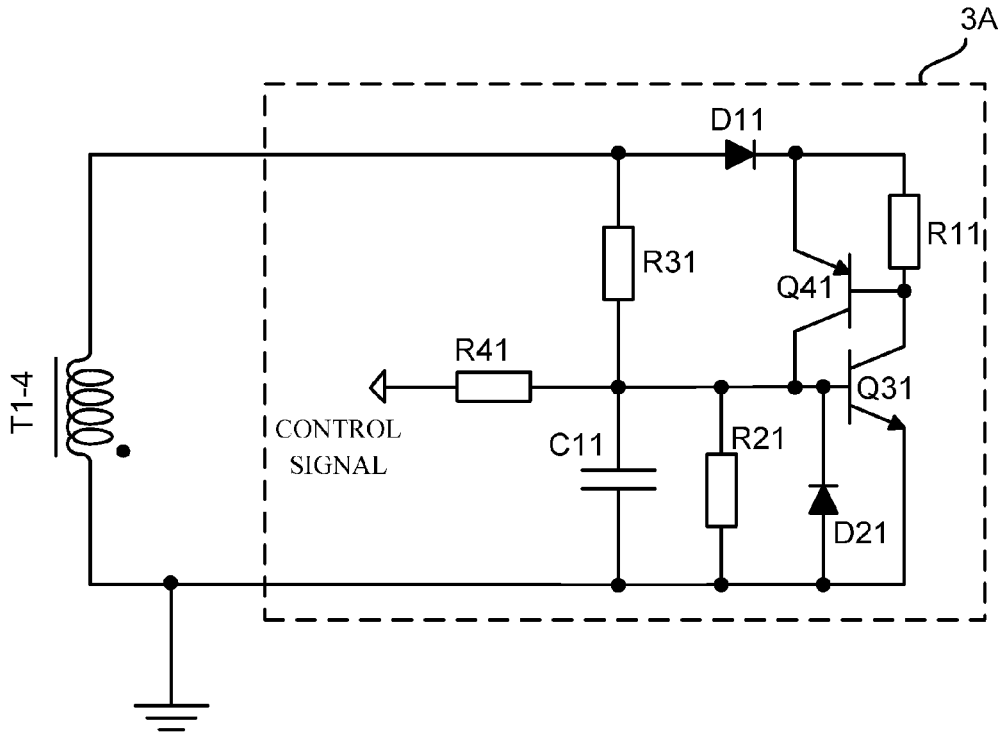
FIG. 3 illustratively shows a structure of a control driving circuit in the electronic ballast of the present application.

FIG. 3 illustratively shows a structure of the control driving circuit 3A in the electronic ballast of the present application, in which the control driving circuit 3A is a clamping circuit. In FIG. 3, the clamping circuit electrically connected with the inductive winding T1-4 is taken as an example for illustration. The clamping circuit may include a NPN BJT Q31, a PNP BJT Q41, a first resistor R11 and a second resistor R21. A collector of the NPN BJT Q31 is electrically connected with a base of the PNP BJT Q41. A collector of the PNP BJT Q41 is electrically connected with a base of the NPN BJT Q31. The base of the PNP BJT Q41 is electrically connected with an emitter of the PNP BJT Q41 through the first resistor R11. The base of the NPN BJT Q31 is electrically connected with an emitter of the NPN BJT Q31 through the second resistor R21. The base of the NPN BJT Q31 serves as an input terminal of the clamping circuit for receiving the control signal. The emitter of the NPN BJT Q31 and the emitter of the PNP BJT Q41 are electrically connected with two terminals of the inductive winding T1-4 respectively.

The clamping circuit may further include a third resistor R31, an input resistor R41, a first capacitor C11, a first diode D11 and a second diode D21. The collector of the PNP BJT Q41 is electrically connected with the emitter of the PNP BJT Q41 through the third resistor R31 and the first diode D11. An anode of the first diode D11 and one terminal of the third resistor R31 are electrically connected with one terminal of the inductive winding T1-4, and a cathode of the first diode D11 is electrically connected with the emitter of the PNP BJT Q41. The base of the NPN BJT Q31 is electrically connected with the emitter of the NPN BJT Q31 through the first capacitor C11 and the second diode D21 which are connected in parallel. An anode and a cathode of the second diode D21 are electrically connected with the emitter and the base of the NPN BJT Q31 respectively. One terminal of the input resistor R41 is electrically connected with the base of the NPN BJT Q31 and the other terminal receives the control signal.

The operating principles of the clamping circuit shown in FIG. 3 will be described below.

When the control signal is received, the first capacitor C11 is charged by the control signal and the inductive winding T1-4, and the voltage at the base of the NPN BJT Q31 increases. When the voltage at the base of the NPN BJT Q31 is higher than a threshold voltage of the NPN BJT Q31, it turns on, and thereby the PNP BJT Q41 and the first diode D11 turn on as well. Consequently, the voltage across the inductive winding T1-4 is pulled down.

With the decrease of the voltage across the inductive winding T1-4, the voltage across the control winding T1-2 is controlled to be lower than the threshold voltage of the transistor Q1 (see FIG. 1), and thus the transistor Q1 switches from on to off. Consequently, in the square wave generator 1, the conducting time of the transistor Q1 corresponding to the inductive wingding T1-4 is controllable. In addition, the first diode D11 plays a role of preventing a reverse current flow.

In the clamping circuit shown in FIG. 3, the NPN BJT Q31 and the PNP BJT Q41 forms a composite circuit which consists of different types of transistors. The composite circuit has a quick switching speed and enables a greater decrease of the voltage across the inductive winding T1-4. However, the embodiments of the present application are not limited to the structure shown in FIG. 3. For example, only one BJT (e.g., only the NPN BJT) may be included in the clamping circuit.

In addition, besides the clamping circuit shown in FIG. 3, other types of clamping circuit may be employed as long as they have the following function: when receiving the control signal the clamping circuits are capable of clamping the voltage across the inductive winding at a low level within a period of time, so that the transistor Q1, controlled by the control winding which is magnetically coupled with the inductive winding, switches from on to off and the conducting time of the transistor Q1 can be shortened. For the type of transistor Q1 in the current embodiment, the clamping circuit is required to clamp the voltage across the inductive winding at a low level, that is to say, removing the driving for the base of the transistor Q1 to make the transistor Q1 switches from on to off. However, for other types of transistor Q1, the clamping circuit may be required to clamp the voltage across the inductive winding at a relatively high level so as to make these types of transistor Q1 switch from on to off. In other embodiments, the clamping circuit may also allow the transistor Q1 to switch from off to on to lengthen the conducting time of the transistor Q1 and thus the working frequency and the output current/voltage of the whole electronic ballast may be changed. Therefore, the output of the clamping circuit may be devised according to the types of the transistor of the square-wave generator or choose to shorten or lengthen the conducting time of the transistor Q1.

Figure 4:
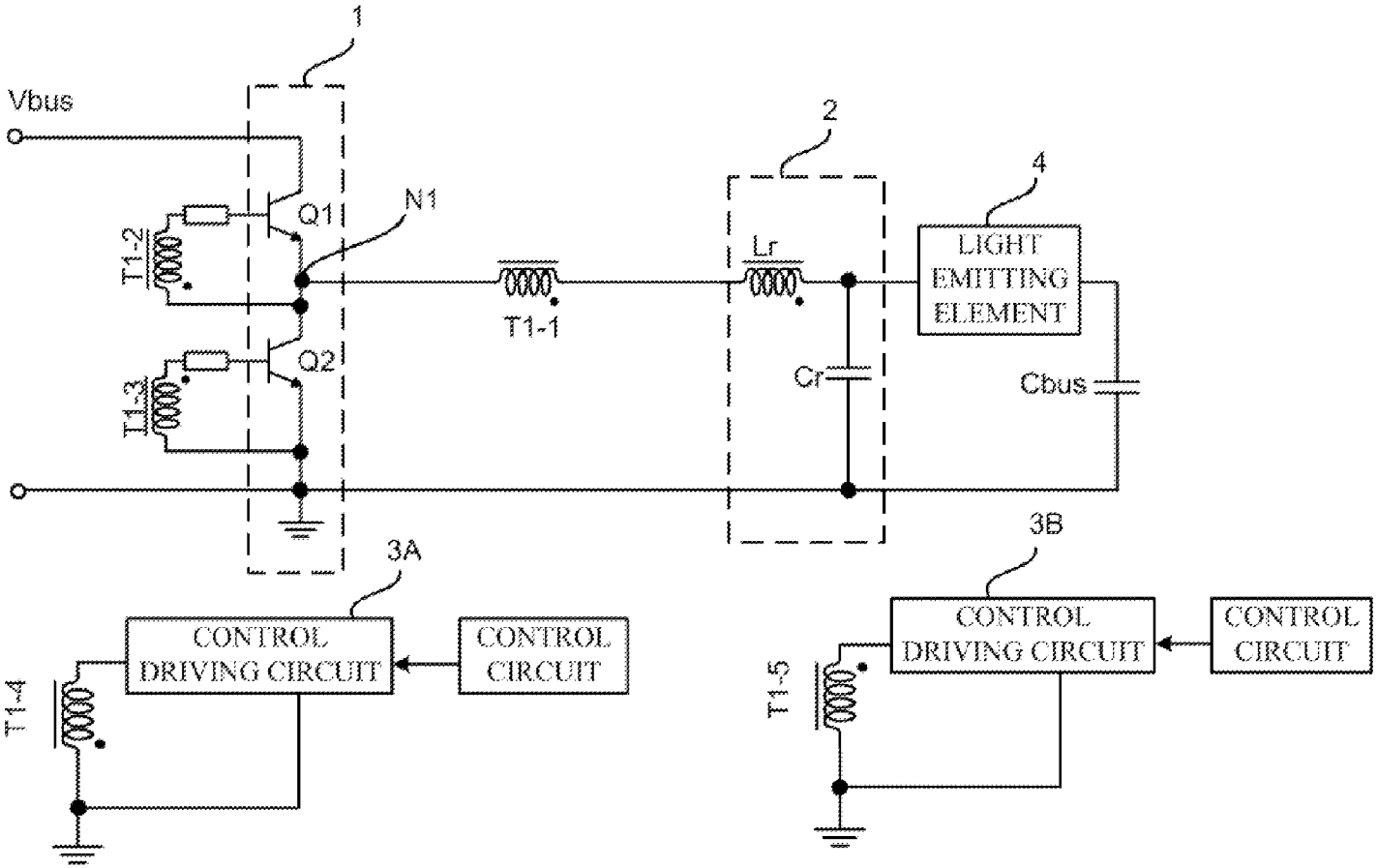
FIG. 4 illustratively shows a structure diagram of an electronic ballast according to a third embodiment of the present application.

FIG. 4 illustratively shows a structure diagram of an electronic ballast according to a third embodiment of the present application. The electronic ballasts provided by the present application may further include at least one control circuit for generating the control signal to be input to the control driving circuit 3A. Vbus is a DC input voltage required by the square wave generator 1. The at least one control circuit may be one dimming control circuit for generating the control signal based on the working current of the light emitting element, or one preheating delay circuit.

Alternatively, the electronic ballasts provided by present application may further include at least two control circuits for generating the control signal to be input to the control driving circuits in a time division manner. The at least two control circuits may include one preheating delay circuit and one dimming control circuit.

Figure 5:
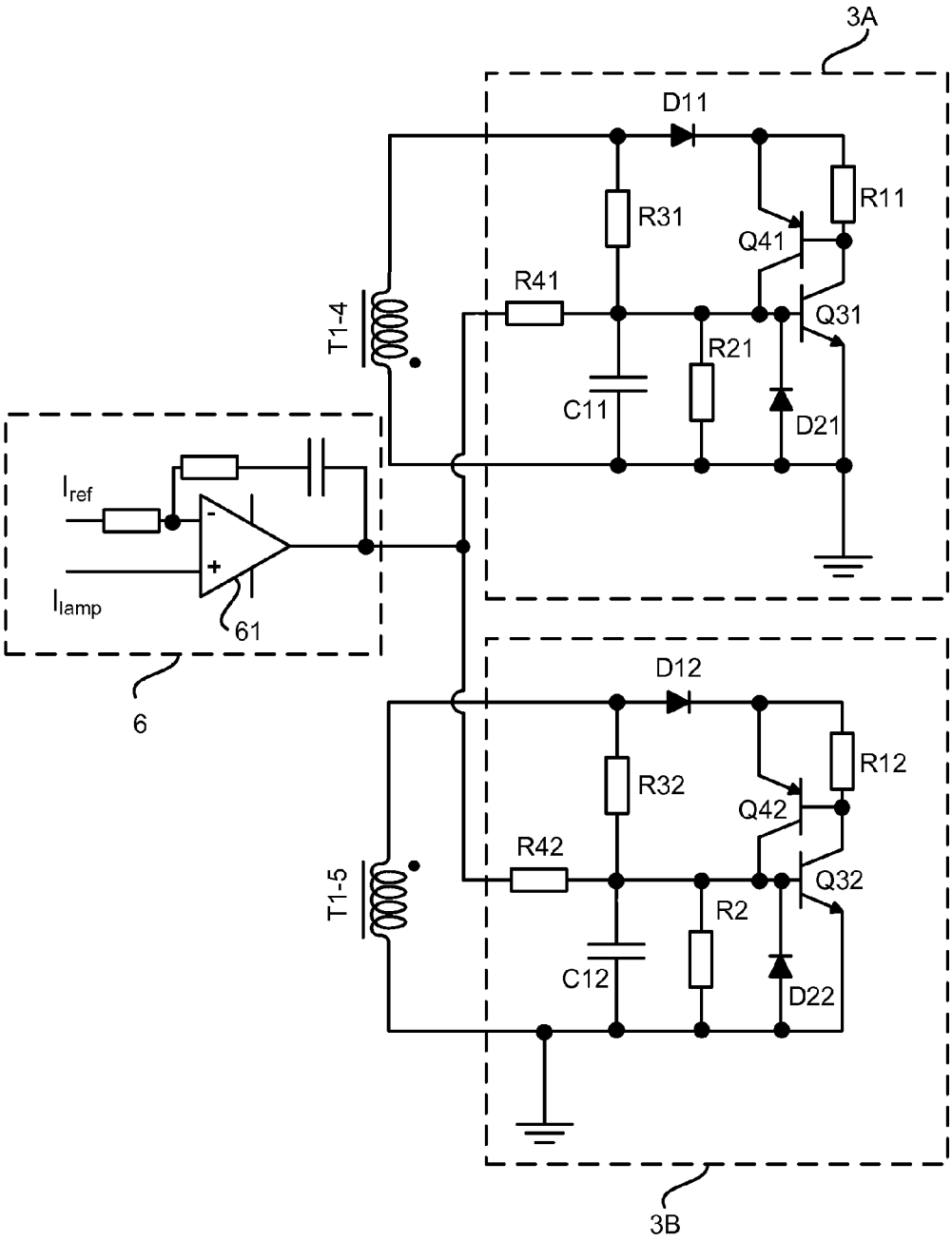
FIG. 5 illustratively shows a structure diagram of an electronic ballast according to a fourth embodiment of the present application.

FIG. 5 illustratively shows a structure diagram of an electronic ballast according to a fourth embodiment of the present application. This embodiment shows a case that the at least one control circuit is one dimming control circuit 6. For the convenience of description, FIG. 5 mainly shows the structures of the dimming control circuit 6, the inductive windings T1-4 and T1-5 and the control driving circuits 3A and 3B. For other structures, please refer to FIG. 1.

In this embodiment, the electronic ballast includes two control driving circuits 3A and 3B, the elements included in the control driving circuit 3B and the connection relationships between these elements are substantially the same with that of the control driving circuit 3A shown in FIG. 3. And the elements with reference signs that have the same characters and the same first numbers immediately adjacent to the same characters refer to the elements having substantially the same types, parameters and functions. For example, reference signs R41 and R42 refer to the respective input resistors in the control driving circuits 3A and 3B, reference signs Q41 and Q42 refer to the PNP BJTs, and reference signs Q31 and Q32 refer to the NPN BJTs. Since the number and the connection relationships of the elements in the control driving circuits 3B and 3A are substantially the same and the operating principles of the control driving circuit 3B are the same as that of the previously described control driving circuit 3A, detailed description is omitted. In other embodiments, the control driving circuits 3A and 3B may also be two kinds of circuit with totally different circuit structures or with the same circuit structure but different element parameters, etc. Therefore, the control driving circuits 3A and 3B may be devised according to varied requirements but not limited to the circuit structures of the control driving circuits 3A and 3B exampled herein.

In this embodiment, the dimming control circuit 6 may include a proportional integral regulator 61 having a positive input terminal to which a sampling current $I_{lamp}$ of the working current of the light emitting element is input, a negative input terminal to which a current preset value $I_{ref}$ is input, and an output terminal which serves as the output terminal of the dimming control circuit 6. Through the input resistors R41 and R42, the output terminal of the dimming control circuit 6 is electrically connected with the bases of the NPN BJTs Q31 and Q32 in the control driving circuits 3A and 3B that controls the inductive windings T1-4 and T1-5.

Figure 6:
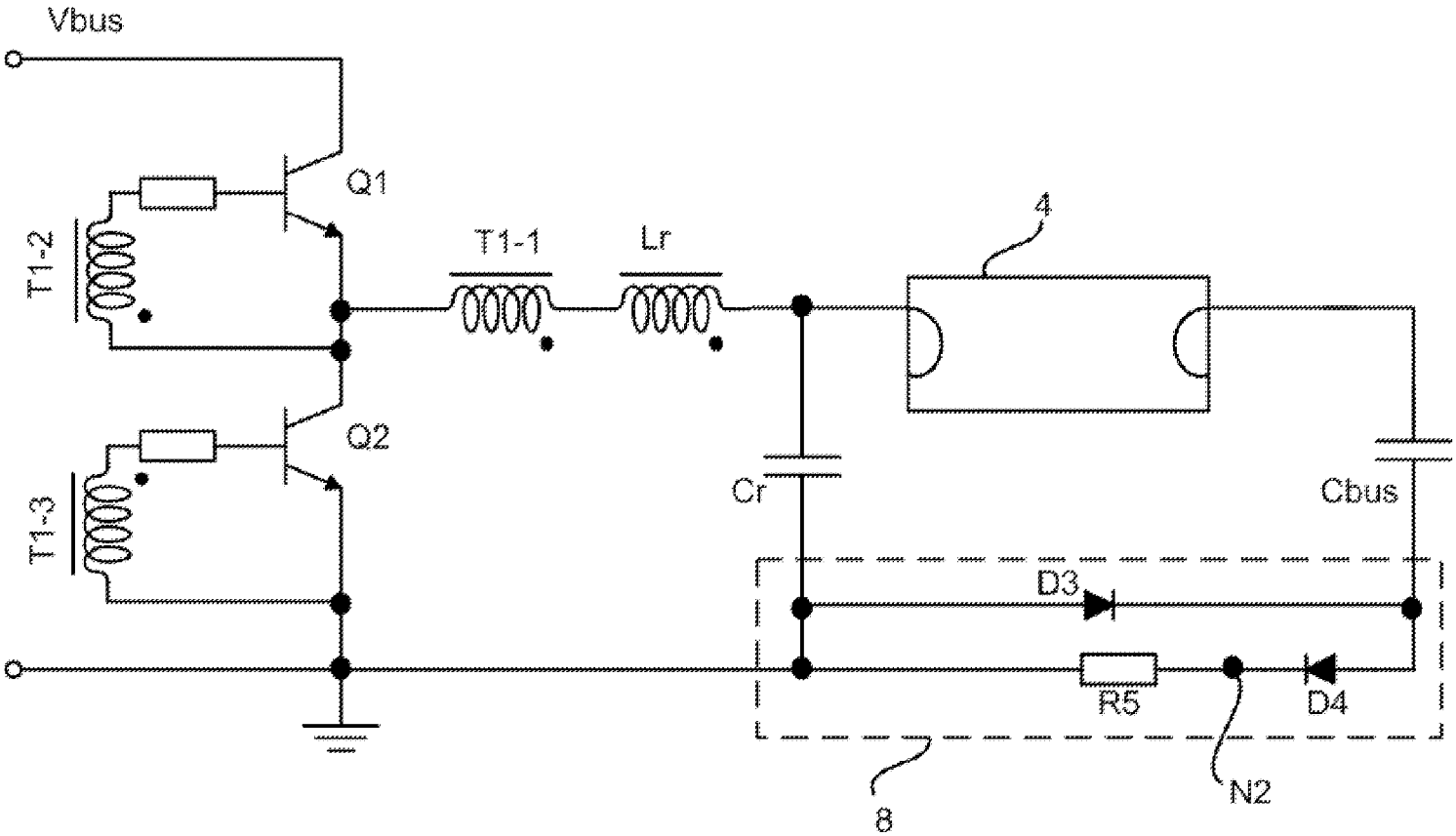
FIG. 6 illustratively shows a structure diagram of a sampling circuit 8 in the electronic ballast of the present application.

FIG. 6 illustratively shows a structure diagram of a sampling circuit 8 in the electronic ballast of the present application. The sampling circuit 8 includes a sampling resistor R5, a third diode D3 and a fourth diode D4. FIG. 6 also shows the connection relationships among the sampling circuit 8 and the light emitting element 4 and the resonant circuit 2. An anode of the third diode D3 is electrically connected with one terminal of the resonant capacitor Cr, and a cathode of the third diode D3 is electrically connected with one terminal of the DC blocking capacitor Cbus and an anode of the fourth diode D4. One terminal of the sampling resistor R5 is electrically connected with the anode of the third diode D3, and the other terminal is electrically connected with the cathode of the fourth diode D4. A node N2 between the sampling resistor R5 and the fourth diode D4 outputs the sampling current of the light emitting element 4 and is electrically connected with the positive input terminal of the proportional integral regulator 61. The sampling circuit may be other types of current sampling circuit, e.g., a current transformer.

The operating principles of the electronic ballast according to the fourth embodiment of the present application will be described with reference to FIGS. 5 and 6.

In the circuits shown in FIG. 5, the control signal output from the output terminal of the proportional integral regulator 61 together with the voltage across the inductive winding T1-4 controls the base of the NPN BJT Q31, and the control signal output from the output terminal of the proportional integral regulator 61 together with the voltage across the inductive winding T1-5 control the base of the NPN BJT Q32.

When the working current of the light emitting element is higher than the preset current value $I_{ref}$, i.e., when the sampling current $I_{lamp}$ output from the sampling circuit 8 is higher than the preset current value $I_{ref}$, the voltage of the control signal output from the output terminal of the proportional integral regulator 61 increases. The difference between the sampling current $I_{lamp}$ and the preset current value $I_{ref}$ determines the magnitude of the voltage of the control signal output from the output terminal of the proportional integral regulator 61. The control signal output from the output terminal of the proportional integral regulator 61 may alternately drive the control driving circuits 3A and 3B to work so as to alternately control the conducting time of the transistors Q1 and Q2 which are correspondingly controlled by the inductive windings T1-4 and T1-5. Thus, the working frequency of the electronic ballast increases, which results in a decrease of the working current and power of the light emitting element 4. When the working current of the light emitting element 4 decreases to be equal to the preset current value $I_{ref}$, under the joint control of the control signal output from the output terminal of the proportional integral regulator 61 together with the partial voltage of the voltages across the inductive windings T1-4 or T1-5 at the bases of the NPN BJTs Q31 and 32, the control circuits 3A or 3B maintain their current states. Thus, the control of the working current of the light emitting element is realized. Similarly, when the sampling current output from the sampling circuit 8 is lower than the preset current value $I_{ref}$, the voltage of the control signal output from the output terminal of the proportional integral regulator 61 decreases, which results in that the conducting time of the transistors Q1 and Q2 lengthens and that the working frequency of the electronic ballast decreases until the working current of the light emitting element 4 rises to the preset current value $I_{ref}$.

Figure 7:
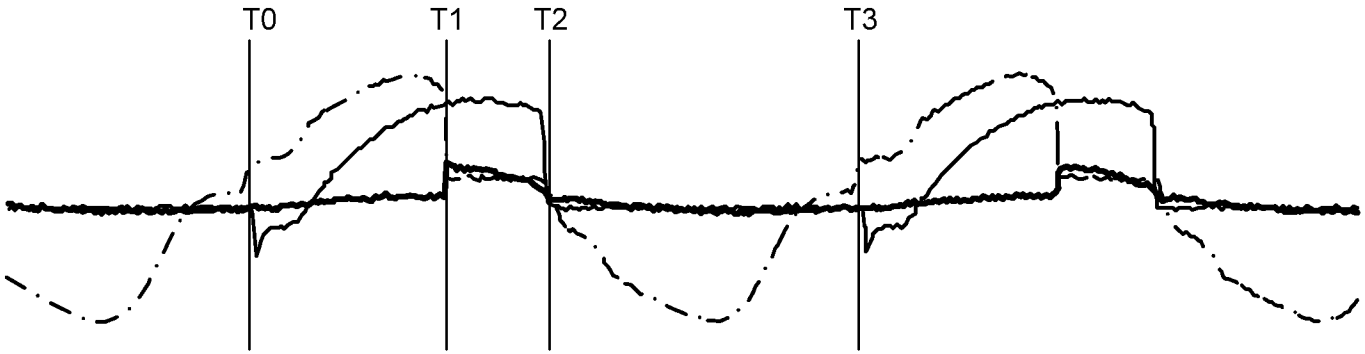
FIG. 7 illustratively shows signal profiles of a voltage across an inductive winding T1-4, a current flowing through a first diode D11 and a current flowing through a first transistor Q1 in a control driving circuit 3A that is electrically connected with the inductive winding T1-4 in FIG. 5.

FIG. 7 illustratively shows signal profiles of a voltage across the inductive winding T1-4, a current flowing through the first diode D11 in the control driving circuit 3A that is electrically connected with the inductive winding T1-4 and a current flowing through the first transistor Q1 in FIG. 5. In FIG. 7, the dash-dot line represents the voltage across the inductive winding T1-4, the thick solid line represents the current flowing through the first diode D11, and the thin solid line represents the current flowing through the first transistor Q1.

In FIG. 7, during the time period from T0 to T1, the voltage across the inductive winding T1-4 is positive, and the voltage at the base of the NPN BJT Q31 in the control driving circuit 3A is increasing but has not yet reached the threshold voltage of the NPN BJT Q31 (see FIG. 5). During the time period from T1 to T2, under the joint control of the voltage across the inductive winding T1-4 together with the control signal output from the output terminal of the proportional integral regulator 61, the voltage at the base of the NPN BJT Q31 reaches the threshold voltage of the NPN BJT Q31, then the transistor Q31 turns on and the control driving circuit 3A starts to work. Thus, during the time period from T1 to T2, the voltage across the inductive winding T1-4 is clamped and the conducting time of the transistor Q1 is shortened. During the time period from T2 to T3, the voltage across the inductive winding T1-4 becomes negative; the voltage at the base of the NPN BJT Q31 is decreasing and then the NPN BJT Q31 turns off, and the control driving circuit 3A stops working.

In FIG. 7, the operating process of the inductive winding T1-5 is similar with that of the inductive winding T1-4 except that the inductive winding T1-5 correspondingly controls the transistor Q2. The connection between the dotted terminal of the inductive winding T1-5 and the transistor Q2 is opposite to that between the dotted terminal of the inductive winding T1-4 and the transistor Q1, so as to respectively control the conducting time of the transistors Q1 and Q2 which turn on alternately. Detailed description is omitted due to the same operating principles. It can be seen that the control circuit (i.e., the proportional integral regulator) provided in FIG. 5 is actually a closed loop control circuit that can keep the working current of the light emitting element being within a range close to the preset current value $I_{ref}$.

By employing the above electronic ballast provided by the disclosure, adjustments to the working current of the light emitting element 4 according to requirements is realized through the control circuit and the control driving circuits 3A and/or 3B, so that the working current of the light emitting element 4 can be kept within a range close to the preset current value $I_{ref}$. For example, a same preset current value $I_{ref}$ can be set for a batch of electronic ballasts with the same design, and thus the working current of each light emitting element can be maintained at close to the preset current value $I_{ref}$, which avoids that each light emitting element has different working current due to the manufacturing errors of the transformers. Moreover, by employing the electronic ballast of the fourth embodiment and through setting different preset current values $I_{ref}$ by the control circuit (i.e., the proportional integral regulator), the adjustment to the current flowing through the light emitting element or to the power of the light emitting element can be realized, i.e., a brightness adjustment can be realized. As compared with the embodiment of electric ballast shown in FIG. 1, the fourth embodiment has a plurality of inductive windings which can control the conducting time of the transistors that turn on at different periods, and thus can provide a more powerful control of the output of the square wave generator, so as to satisfy broader adjustment requirements of users.

Figure 8:
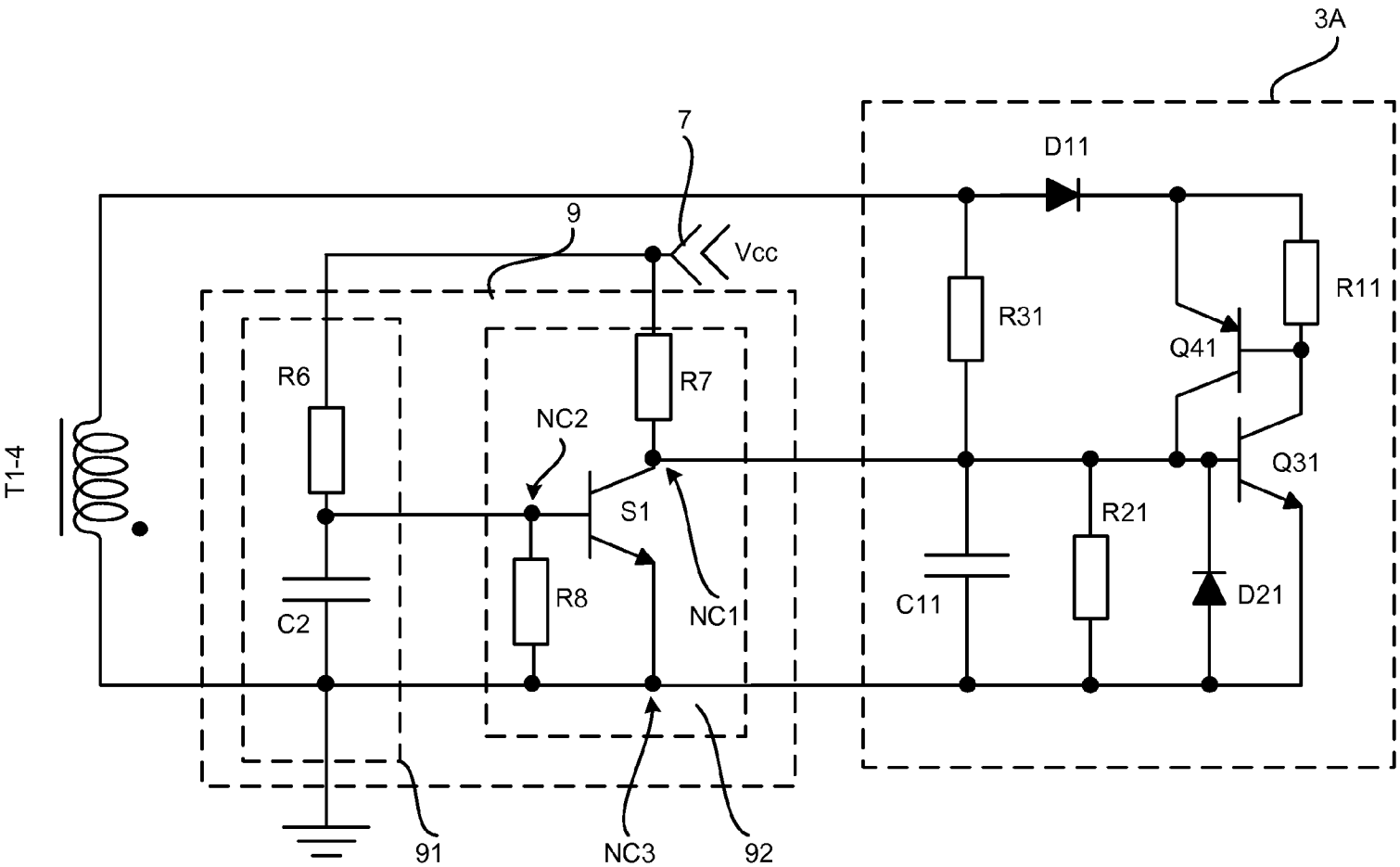
FIG. 8 illustratively shows a structure diagram of an electronic ballast according to a fifth embodiment of the present application.

FIG. 8 illustratively shows a structure diagram of an electronic ballast according to a fifth embodiment of the present application. This embodiment shows a case that the at least one control circuit is one preheating delay circuit 9. The output of preheating delay circuit 9 may shorten the conducting time of the switching element, which is controlled by the inductive winding electrically connected with the control driving circuit 3A. After a preset delay time, the preheating delay circuit 9 loses its control on the control driving circuit 3A. For the convenience of description, FIG. 8 mainly shows the structures of the control circuit 5, the preheating delay circuit 9, the inductive winding T1-4 and the control driving circuit 3A. For other structures, please refer to FIG. 1.

The preheating delay circuit 9 is electrically connected with a charging power supply 7 and includes a delay branch 91 and a switching branch 92 controlled by the delay branch 91. The delay branch 91 includes a charging resistor R6 and a charging capacitor C2 connected in cascade with the charging resistor R6. One terminal of the charging capacitor C2 is connected with the ground, and the charging power supply 7 charges the charging capacitor C2 through the charging resistor R6. The switching branch 91 includes a switching transistor S1, a first voltage-limiting resistor R7 and a second voltage-limiting resistor R8. One terminal of the first voltage-limiting resistor R7 electrically is connected with the charging power supply 7, and the other terminal electrically is connected with one terminal of the switching transistor S1 to form a first common node NC1. One terminal of the second voltage-limiting resistor R8 together is connected with a control terminal of the switching transistor S1 to form a second common node NC2, the other terminal is connected with the other terminal of the switching transistor S1 to form a third common node NC3. The first common node NC1 is the output terminal of the preheating delay circuit 9, and the third common node NC3 is electrically connected with one terminal of the inductive winding T1-4. In the current embodiment, the delay time of the delay circuit 9 actually depends on the specific parameters of the charging resistor R6, the charging capacitor C2 and the second voltage-limiting resistor R8. In other embodiments of the delay circuits, the second voltage-limiting resistor R8 may be omitted, and the delay time of the delay circuit 9 may only depend on the parameters of the elements in the delay branch 91. Moreover, the charging power supply 7 may be from the square wave generator 1 or the PFC circuit 5.

The operating principles of the fifth embodiment will be described below with reference to FIG. 8.

For some light emitting elements, e.g., fluorescent lamps, filament preheating plays an important role for prolonging the life span of the light emitting elements. Thus, a warm start of the light emitting element is realized by the preheating delay circuit 9 and the control driving circuit 3A in the embodiments of the present application.

The preheating of the light emitting element may last for a period of time, e.g., about 0.4 second to 2 seconds. The preheating lasting time may be devised according to the actual field application. Then, the light emitting element may be ignited, and then go into a steady operation stage. During the preheating stage, the working frequency of the electronic ballast is controlled to be at a higher value, and thus the output voltage of the electronic ballast is maintained at a proper value, so as to avoid the ignition of the fluorescent lamp. The working frequency of the electronic ballast during the preheating stage is higher than the working frequency of the fluorescent lamp during the steady operation stage.

Referring to FIG. 8, when the preheating delay circuit 9 starts to work, the charging power supply 7 charges the charging capacitor C2 through the charging resistor R6, and the voltage at the second common node NC2 rises. At that time, because the voltage at the control terminal of the switching transistor S1 has not yet reached its threshold voltage of the switching transistor S1, the switching transistor S1 is maintained at an off state, the voltage at the first common node NC 1 electrically connected with the power supply 7 is maintained at a higher voltage so as to lengthen the conducting time of the NPN BJT Q31 in the control driving circuit 3A. The voltage signal at the first common node NC 1 may be considered as the control signal output from the preheating delay circuit 9. As the NPN BJT Q31 turns on, the control driving circuit 3A works and pulls down the voltage across the inductive winding T1-4 so as to pull down the voltage across the control winding T1-2, and thus the conducting time of the transistor Q1 is shortened and the working frequency of the electronic ballast become higher. At that time, the voltage across the fluorescent lamp is maintained at a value being able to avoid the ignition of the fluorescent lamp but to heat the filament.

In the process of heating the filament, as the voltage across the charging capacitor C2 rises, the voltage at the second common node NC2 rises. When the voltage at the second common node NC2 rises to above the threshold voltage of the switching transistor 51, the switching transistor S1 turns on and then the voltage at the first common node NC 1 is pulled down, which results the NPN BJT Q31 turns off and the control driving circuit 3A stops working. Thus, the inductive winding T1-4 is free from the voltage clamping of the control driving circuit 3A, and the light emitting element may be ignited after the preheating.

After that, due to the charging function of the charging power supply 7 to the charging capacitor C2, the second common node NC2 is maintained at a high voltage, the switching transistor S1 keeps on, the voltage at the first common node NC 1 keeps being pulled down, and the control driving circuit 3A is free from the control of the preheating delay circuit 9.

Figure 9:
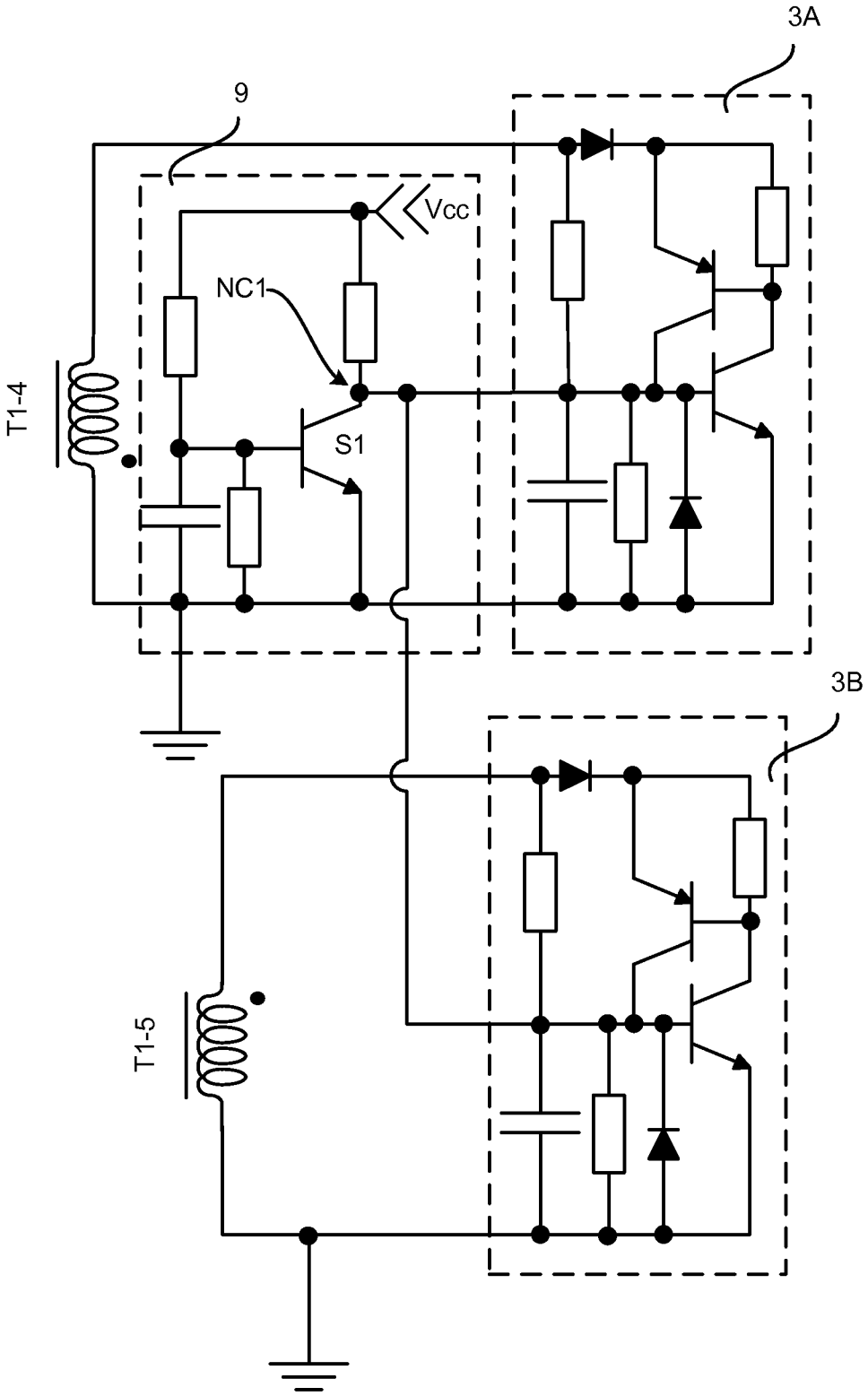
FIG. 9 illustratively shows a structure diagram of an electronic ballast according to a sixth embodiment of the present application.

FIG. 9 illustratively shows a structure diagram of an electronic ballast according to a sixth embodiment of the present application. The embodiment shown in FIG. 9 differs from the one shown in FIG. 8. The electronic ballast of the embodiment shown in FIG. 9 includes two inductive windings T1-4 and T1-5 both of which are electrically connected with the preheating delay circuit 9, while the electronic ballast in the embodiment shown in FIG. 8 only includes one inductive winding T1-4. In the embodiment shown in FIG. 9, the control signal output from the first common node NC1 in the preheating delay circuit 9 controls the control driving circuit 3A electrically connected with the inductive winding T1-4 and the control driving circuit 3B electrically connected with the inductive winding T1-5.

Thus, in the condition that the light emitting element requires preheating before ignition, a designer may choose the fifth or sixth embodiment to realize the preheating of the light emitting element according to design requirements.

Figure 10:
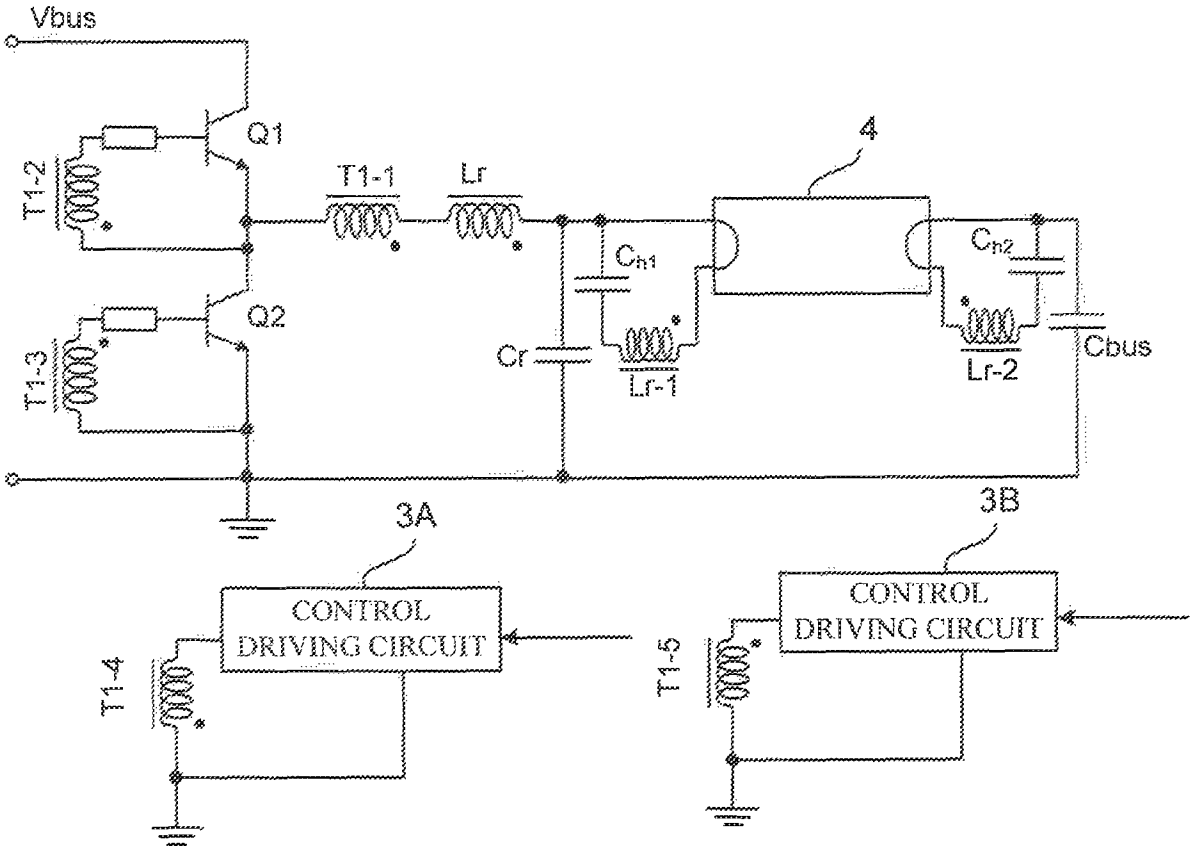
FIG. 10 illustratively shows a preheating diagram of the light emitting element, involved in the present application.

The preheating of the light emitting element in both of the fifth and sixth embodiments may be performed based on FIG. 10 which illustratively shows a preheating diagram of the light emitting element, involved in the present application. The light emitting element 4 is electrically connected with one terminal of a preheating capacitor $C_{h1}$ and one terminal of a preheating capacitor $C_{h2}$ respectively, two terminals of a preheating winding Lr-1 are electrically connected with the other terminal of the preheating capacitor $C_{h1}$ and the light emitting element 4 respectively, two terminals of a preheating winding Lr-2 are electrically connected with the other terminal of the preheating capacitor $C_{h2}$ and the light emitting element 4 respectively. Both of the preheating windings Lr-1 and Lr-2 are coupled with the resonant inductor Lr. In the preheating stage, the filament of the light emitting element is heat by the electric energy of the preheating windings Lr-1 and Lr-2 coupled from the resonant inductor Lr. It can be seen that the preheating winding Lr-1 and Lr-2 serve as a source. Additionally, when heating the light emitting element, other types of device or circuit structure may be employed to heat the filament as well.

Figure 11:
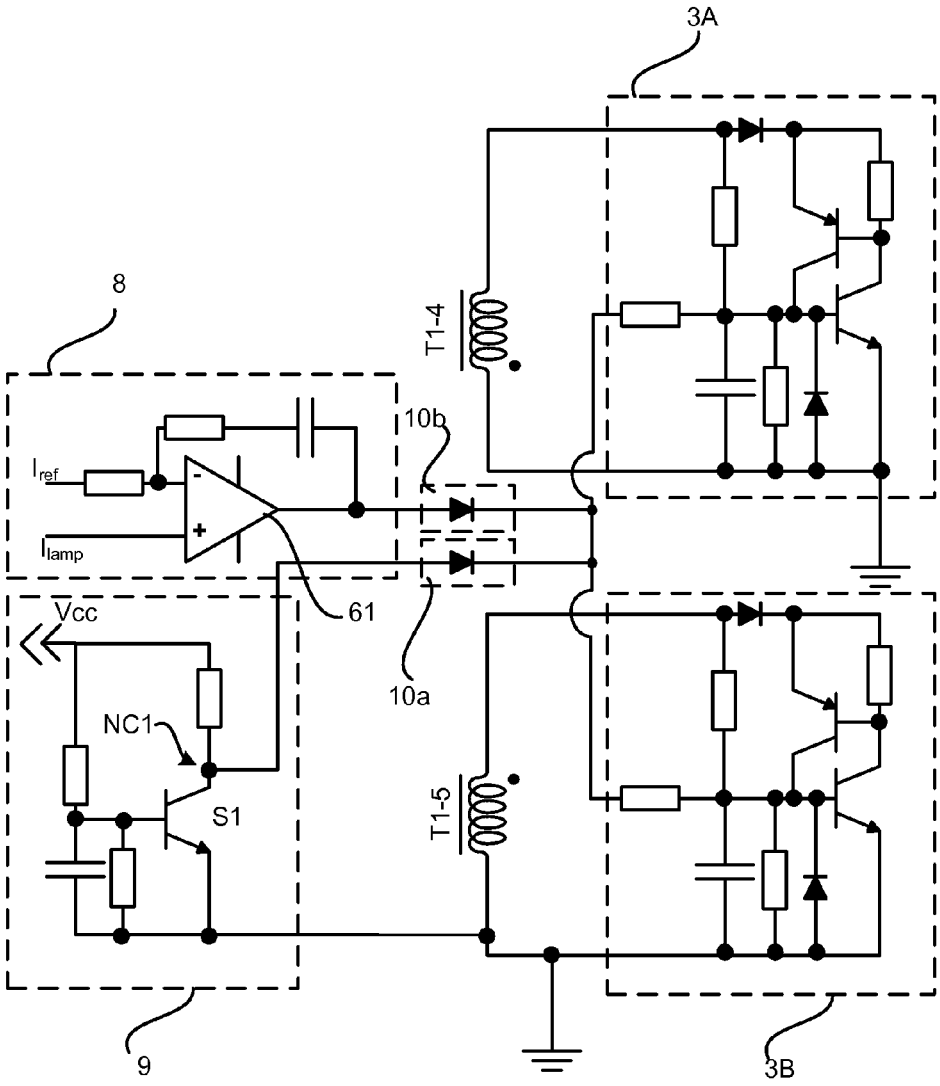
FIG. 11 illustratively shows a structure diagram of an electronic ballast according to a seventh embodiment of the present application.

FIG. 11 illustratively shows a structure diagram of an electronic ballast according to a seventh embodiment of the present application. This embodiment shows a case that at least two control circuits 5 are included in: one is preheating delay circuit 9 and the other one is dimming control circuit 6. For convenience of description, FIG. 11 mainly shows the structures of the control circuit 5, the inductive windings T1-4 and T1-5 and the control driving circuits 3A and 3B. For other structures, please refer to FIG. 1.

In FIG. 11, the connection relationship of each element in the preheating delay circuit 9 is the same as that described above with reference to FIG. 8, and the connection relationship of each element in the dimming control circuit 6 is the same as that described above with reference to FIG. 5.

The operating principles of the electronic ballast shown in FIG. 11 will be described below.

After power on, the light emitting element has not yet been ignited, the sampling current $I_{lamp}$ is zero, and the output of the output terminal of the proportional integral regulator 61 is zero or a low level. The control signal output from the preheating delay circuit 9 controls the control driving circuits 3A and 3B, which is called as the preheating stage. In the preheating stage, the first common node NC1 is maintained at a higher voltage, i.e., the preheating delay circuit outputs the control signal, so as to make the control driving circuits 3A and 3B work. Under the control of the preheating delay circuit, the working frequency of the electronic ballast become higher so as to control the heating time of the filament before the ignition of the light emitting element.

After a predefined time that is determined by the preheating delay circuit 9 passes, the voltage at the first common node NC1 will be pulled down, and the preheating delay circuit 9 loses the control on the control driving circuits 3A and 3B. Then, the working frequency of the electronic ballast decreases and the light emitting element is ignited. The light emitting element enters into the steady operation stage after ignition. In the steady operation stage, if the sampling current $I_{lamp}$ is higher than the preset current value $I_{ref}$, the control signal output from the dimming control circuit 6 will change, so as to make the control driving circuits control the conducting time of the transistors Q1 and Q2 (see FIG. 1) that are corresponding to the inductive windings T1-4 and T1-5 respectively, become shorter, and thus the working frequency of the electronic ballast becomes higher and the working current of the light emitting element decreases. When the sampling current $I_{lamp}$ goes into equaling to the preset current value $I_{ref}$, the control signal output from the dimming control circuit 6 keeps steady. Similarly, when the sampling current $I_{lamp}$ is lower than the preset current value $I_{ref}$, the control signal output from the dimming control circuit 6 will change so as to make the control driving circuits control the conducting time of the transistors Q1 and Q2 that are corresponding to the inductive windings T1-4 and T1-5 respectively, become longer, and thus the working frequency of the electronic ballast becomes lower and the working current of the light emitting element increases.

In the structure shown in FIG. 11, an unidirectional conducting element 10*a* may be electronically connected between the output terminal of the preheating delay circuit 9 and the control driving circuits 3A and 3B, so as to prevent a reverse current flow. An unidirectional conducting element 10*b* may be electronically connected between the output terminal of the proportional integral regulator 61 and the control driving circuits 3A and 3B to prevent a reverse current flow.

The unidirectional conducting elements 10*a* and 10*b* may be diodes, or may be other elements that have a function of preventing a reverse current flow.

In the previous embodiments, description is made mainly by taking the example that the square wave generator is a half-bridge inverter. If the square wave generator is a full-bridge inverter, the conducting time of each switching element in the full-bridge inverter may be controlled as well by the control driving circuits, so as to realize the control on the working frequency of the electronic ballast. Basic operating principles are similar with that described previously with reference to the half-bridge inverter.

In summary, in the electronic ballast provided by the present application, using the coupling between the inductive windings and the control windings, the control on the conducting time of the switching elements is realized by controlling the voltages across the inductive windings and thereby the voltages across the control windings through the control driving circuits. Thus, the control on the working current or power of the light emitting element is realized.

In addition, the electronic ballast in the present application realizes a warm start by using the preheating delay circuit and the control driving circuit, and thus the life span of the light emitting element may be extended.

In addition, the electronic ballast in the present application realizes dimming by using the dimming control circuit and the control driving circuit, so as to adjust the brightness of the light emitting element according to requirements, or obtains an effect of reducing the differences among different electronic ballasts.

Although the present application has been described with reference to typical embodiments, it should be understood that the terminologies herein are for illustration rather than to limit the present application. The present application can be implemented in many specific embodiments without departing from the spirit and scope of the present application, and thus it shall be appreciated that the above embodiments shall not be limited to any details described above, but shall be interpreted broadly within the scope defined by the appended claims. The appended claims intend to cover all the modifications and changes falling within the scope of the appended claims and equivalents thereof.

What is claimed is:

1. An electronic ballast for driving at least one light emitting element, comprising:

a square-wave generator that comprises a plurality of switching elements which turn on alternately to convert a direct current input voltage to an alternating current square wave of output voltage;

a transformer that comprises a driving winding, a plurality of control windings and at least one inductive winding, wherein the driving winding, the control windings and the inductive winding are coupled with each other, and the plurality of control windings are electrically connected with control terminals of the plurality of switching elements respectively so as to control the plurality of switching elements to turn on alternately;

a resonant circuit that constitutes a resonant loop together with the driving winding, is electrically connected with an output terminal of the square wave generator and drives the light emitting element; and at least one control driving circuit that is connected with two terminals of the inductive winding in parallel and receives a control signal to control a voltage across the inductive winding so as to control conducting time of at least one of the switching elements.

2. The electronic ballast according to claim 1, wherein the number of the inductive windings is at least two, both of which control two of the switching elements that turn on alternately.

3. The electronic ballast according to claim 2, wherein the number of the control driving circuits is at least two, both of which are electrically connected with two of the inductive windings respectively.

4. The electronic ballast according to claim 1, wherein the control driving circuit is a clamping circuit which receives the control signal so as to clamp the voltage of the inductive winding to control the conducting time of the switch element which is controlled by the control winding corresponding to the inductive winding.

5. The electronic ballast according to claim 4, wherein the clamping circuit comprises a NPN bipolar junction transistor, a PNP bipolar junction transistor, a first resistor and a second resistor; a collector of the NPN bipolar junction transistor is electrically connected with a base of the PNP bipolar junction transistor, a collector of the PNP bipolar junction transistor is electrically connected with a base of the NPN bipolar junction transistor, the base of the PNP bipolar junction transistor is electrically connected with an emitter of the PNP bipolar junction transistor through the first resistor, the base of the NPN bipolar junction transistor is electrically connected with an emitter of the NPN bipolar junction transistor through the second resistor, the base of the NPN bipolar junction transistor serves as an input terminal of the clamping circuit for receiving the control signal, and the emitter of the NPN bipolar junction transistor and the emitter of the PNP bipolar junction transistor are electrically connected with the two terminals of the inductive winding.

6. The electronic ballast according to claim 5, wherein the clamping circuit further comprises a third resistor, an input resistor, a first capacitor, a first diode and a second diode; the collector of PNP bipolar junction transistor is electrically connected with the emitter of the PNP bipolar junction transistor through the third resistor and the first diode, an anode of the first diode and one terminal of the third resistor are electrically connected with one terminal of the inductive winding, an cathode of the first diode is electrically connected with the emitter of the PNP bipolar junction transistor, the base of the NPN bipolar junction transistor is electrically connected with the emitter of the NPN bipolar junction transistor through the first capacitor and the second diode which are connected in parallel, an anode and a cathode of the second diode are electrically connected with the emitter and the base of the NPN bipolar junction transistor respectively, and one terminal of the input resistor is electrically connected with the base of the NPN bipolar junction transistor and the other terminal receives the control signal.

7. The electronic ballast according to claim 1, further comprising a control circuit which generates the control signal to be input to the control driving circuit.

8. The electronic ballast according to claim 7, wherein the control circuit is a preheating delay circuit, the output of said preheating delay circuit could shorten the conducting time of the switching element during a preset delay time, and lose the control on the switching element after the preset delay time.

9. The electronic ballast according to claim 8, wherein the preheating delay circuit is electrically connected with a charging power supply and comprises:

a delay branch comprising a charging resistor and a charging capacitor connected in series with the charging resistor, wherein one terminal of the charging capacitor is connected with a ground, and the charging power supply charges the charging capacitor through the charging resistor; and a switching branch controlled by the delay branch, comprising a switching transistor, a first voltage-limiting resistor and a second voltage-limiting resistor, wherein one terminal of the first voltage-limiting resistor is electrically connected with the charging power supply and the other terminal of the first voltage-limiting resistor is connected with one terminal of the switching transistor to form a first common node; one terminal of the second voltage-limiting resistor is connected with one control terminal of the switching transistor to form a second common node and the other terminal of the second voltage-limiting resistor is connected with another terminal of the switching transistor to form a third common node; the first common node is as an output terminal of the preheating delay circuit and the third common node is electrically connected with one terminal of the inductive winding.

10. The electronic ballast according to claim 7, wherein the control circuit is a dimming control circuit.

11. The electronic ballast according to claim 10, wherein the dimming control circuit comprises a proportional integral regulator which has a positive terminal as an input for a sampling current indicating a current of the light emitting element and a negative terminal as an input for preset current value of the light emitting element.

12. The electronic ballast according to claim 11, further comprising a sampling circuit, wherein the sampling circuit outputs said sampling current.

13. The electronic ballast according to claim 1, further comprising at least two control circuits, both of which generate the control signal input to the control driving circuits in a time division manner.

14. The electronic ballast according to claim 13, wherein two of the control circuits are one preheating delay circuit and one dimming control circuit; the preheating delay circuit produces an output to enable the control driving circuit to shorten the conducting time of the switching elements during a preset delay time, and loses the control on the control driving circuit after the preset delay time.

15. The electronic ballast according to claim 14, wherein the preheating delay circuit is electrically connected with a charging power supply and comprises:

a delay branch, comprising a charging resistor and a charging capacitor connected in series with the charging resistor, wherein one terminal of the charging capacitor is connected with a ground, and the charging power supply charges the charging capacitor through the charging resistor; and a switching branch controlled by the delay branch, comprising a switching transistor, a first voltage-limiting resistor and a second voltage-limiting resistor, wherein one terminal of the first voltage-limiting resistor is electrically connected with the charging power supply and the other terminal of the first voltage-limiting resistor is connected with one terminal of the switching transistor to form a first common node; one terminal of the second voltage-limiting resistor is connected with one control terminal of the switching transistor to form a second common node and the other terminal of the second voltage-limiting resistor is connected with another terminal of the switching transistor to form a third common node; the first common node is as an output terminal of the preheating delay circuit and the third common node is electrically connected with one terminal of the inductive winding.

16. The electronic ballast according to claim 15, further comprising a unidirectional conducting element which is electrically connected between the output terminal of the preheating delay circuit and the control driving circuit.

17. The electronic ballast according to claim 14, wherein the dimming control circuit is a proportional integral regulator which has a positive terminal as an input for a sampling current of a current of the light emitting element is input and a negative terminal as an input for a preset current value of the light emitting element.

18. The electronic ballast according to claim 17, further comprising a sampling circuit, wherein the sampling circuit outputs said sampling current.

19. The electronic ballast according to claim 17, further comprising a unidirectional conducting element which is electrically connected between an output terminal of the proportional integral regulator and the control driving circuit.

20. The electronic ballast according to claim 1, wherein the square wave generator is a half-bridge inverter which comprises two switching elements, and the number of the control windings is two and both of which are electrically connected with the control terminals of the two switching elements respectively.

* * * * *